US011712893B2

(12) United States Patent
Kanzaki et al.

(10) Patent No.: US 11,712,893 B2
(45) Date of Patent: Aug. 1, 2023

(54) LIQUID DISCHARGE HEAD

(71) Applicant: BROTHER KOGYO KABUSHIKI KAISHA, Nagoya (JP)

(72) Inventors: Shotaro Kanzaki, Handa (JP); Toru Kakiuchi, Chita (JP); Takaaki Yoshino, Nagoya (JP); Taisuke Mizuno, Yokkaichi (JP); Jiro Yamamoto, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 49 days.

(21) Appl. No.: 17/533,842

(22) Filed: Nov. 23, 2021

(65) Prior Publication Data

US 2022/0203682 A1 Jun. 30, 2022

(30) Foreign Application Priority Data

Dec. 25, 2020 (JP) ..... 2020-216686

(51) Int. Cl.
*B41J 2/14* (2006.01)
*B41J 2/18* (2006.01)

(52) U.S. Cl.
CPC ..... *B41J 2/14201* (2013.01); *B41J 2/18* (2013.01); *B41J 2002/14419* (2013.01); *B41J 2202/12* (2013.01)

(58) Field of Classification Search
CPC ..... B41J 2/14201; B41J 2/18; B41J 2002/14419; B41J 2202/12; B41J 2/14233
See application file for complete search history.

(56) References Cited

U.S. PATENT DOCUMENTS

2010/0238238 A1* 9/2010 Yamamoto ..... B41J 2/18 347/85

FOREIGN PATENT DOCUMENTS

JP 2010-214847 A 9/2010

OTHER PUBLICATIONS

IP.com search (Year: 2023).*
Global Dossier search (Year: 2023).*

* cited by examiner

*Primary Examiner* — Lisa Solomon
(74) *Attorney, Agent, or Firm* — Kenealy Vaidya LLP

(57) ABSTRACT

A liquid discharge head is provided, the liquid discharge head comprising a plurality of individual channels, a first manifold connected to the plurality of individual channels, a second manifold connected to the plurality of individual channels, and a bypass channel connecting the first manifold and the second manifold and being distinct from the individual channels. A flow channel resistance Rct brought about by the plurality of individual channels, a flow channel resistance Rbp of the bypass channel, a bending loss ΔP provided when the liquid flows from the first manifold via the bypass channel to the second manifold, and a flow rate Q of the liquid flowing through the bypass channel fulfill a relationship of:

$$0.5<[Rct/(Rbp+(\Delta P/Q))]<2.0.$$

9 Claims, 7 Drawing Sheets

LIQUID DISCHARGE HEAD

CROSS REFERENCE TO RELATED APPLICATIONS

The present application claims priority from Japanese Patent Application No. 2020-216686, filed on Dec. 25, 2020, the disclosure of which is incorporated herein by reference in its entirety.

BACKGROUND

A head unit, which performs recording by jetting an ink from the nozzles, is known as an exemplary liquid discharge head for jetting a liquid from nozzles. In the case of a certain known head unit, a plurality of pressure chambers, which are connected to the nozzles, are arranged in one direction. Further, a supply side manifold and a circulation side manifold, which extend in the one direction, are arranged on both sides of the plurality of pressure chambers in a direction orthogonal to the one direction. The plurality of pressure chambers are connected to the supply side manifold via ink supply flow passages respectively, and the plurality of pressure chambers are connected to the circulation side manifold via ink circulation flow passages respectively. Further, the supply side manifold and the circulation side manifold are connected via a bypass channel.

Accordingly, in the case of the head unit described above, the ink flows through the plurality of pressure chambers from the supply side manifold to the circulation side manifold, and the ink flows via the bypass channel. Further, the flow passages are formed so that the flow channel resistance r of the flow passage ranging from the supply side manifold via the pressure chambers to arrive at the circulation side manifold, the number N of the pressure chambers connected to the same supply side manifold and the circulation side manifold, and the flow channel resistance R of the bypass channel fulfill a relationship of $(r/N)<R<r$. It is considered that when the flow channel resistances r, R fulfill the relationship as described above, any great difference does not appear between the flow rate of the ink flowing from the supply side manifold to the circulation side manifold via the plurality of pressure chambers and the flow rate of the ink flowing from the supply side manifold to the circulation side manifold via the bypass channel.

SUMMARY

In the case of the known head unit described above, taking notice of only the flow channel resistance r and the flow channel resistance R, the flow passages are formed so that $(r/N)<R<r$ is fulfilled. However, in the case of the known head unit described above, the direction of the flow of the ink greatly changes when the ink flows from the supply side manifold via the bypass channel to the circulation side manifold. Any pressure loss (bending loss) arises on account of the change in the direction in which the ink flows. On this account, when the flow passages are formed taking notice of only the flow channel resistance r and the flow channel resistance R so that $(r/N)<R<r$ is fulfilled, it is feared that any great difference may appear due to the influence of the bending loss between the flow rate of the ink flowing from the supply side manifold to the circulation side manifold via the plurality of pressure chambers and the flow rate of the ink flowing from the supply side manifold to the circulation side manifold via the bypass channel.

An object of the present disclosure is to provide a liquid discharge head which is useful to reliably equalize a flow rate of a liquid flowing from a first manifold to a second manifold via a plurality of individual channels and a flow rate of the liquid flowing from the first manifold to the second manifold via a bypass channel.

According to an aspect of the present disclosure, there is provided a liquid discharge head including: a plurality of individual channels; a first manifold; a second manifold; and a bypass channel. The plurality of individual channels is arranged in one direction and includes a plurality of nozzles respectively. The first manifold extends in the one direction, is connected to the plurality of individual channels, and includes a supply port for a liquid. The second manifold extends in the one direction, is connected to the plurality of individual channels, and includes a discharge port for the liquid. The bypass channel connects the first manifold and the second manifold, the bypass channel is distinct from the individual channels. A flow channel resistance Rct brought about by the plurality of individual channels, a flow channel resistance Rbp of the bypass channel, a bending loss ΔP provided when the liquid flows from the first manifold via the bypass channel to the second manifold, and a flow rate Q of the liquid flowing through the bypass channel fulfill a relationship of:

$$0.5<[Rct/(Rbp+(\Delta P/Q))]<2.0.$$

DETAILED DESCRIPTION

An embodiment of the present disclosure will be explained below.

<Overall Configuration of Printer 1>

Figure 1:
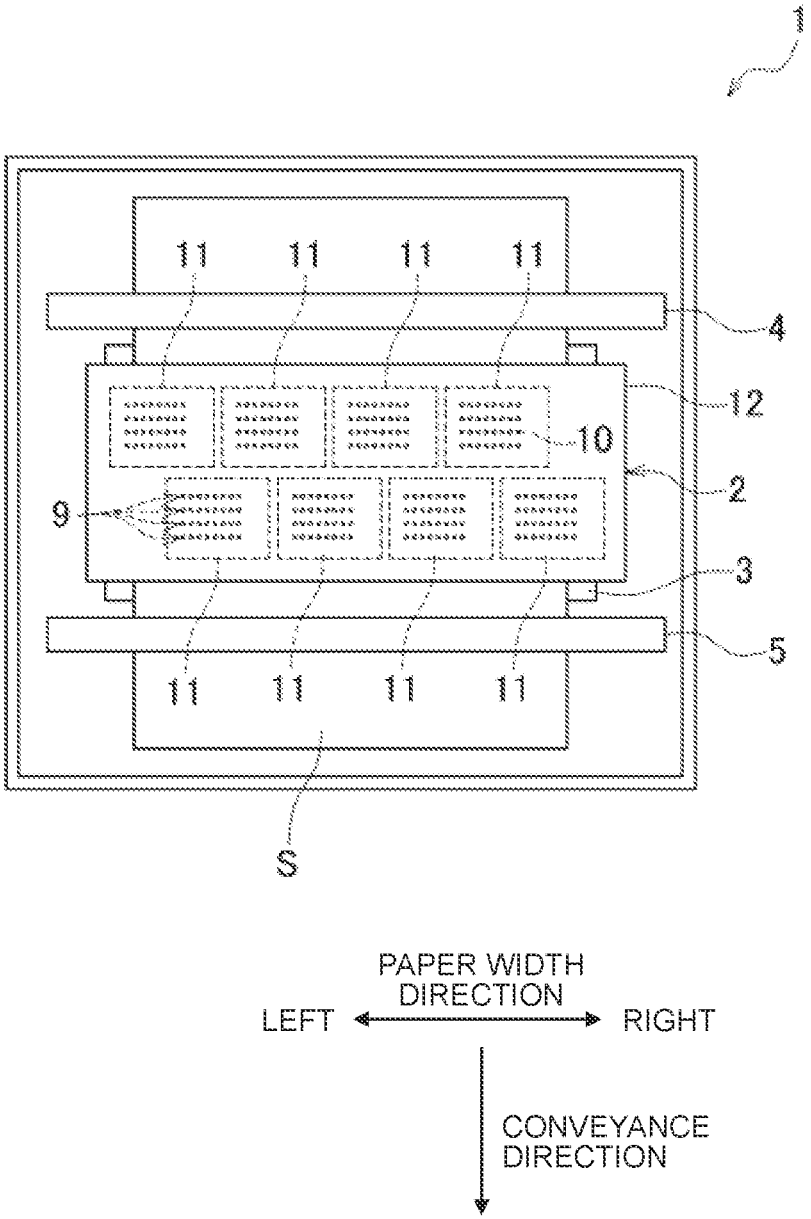
FIG. 1 is a view of schematic configuration of a printer 1.

As depicted in FIG. 1, a printer 1 according to this embodiment is provided with a head unit 2, a platen 3, and conveying roller pairs 4, 5.

The head unit 2 has eight heads 11 ("liquid discharge heads" of the present disclosure) and a head holder 12. Each four of the eight heads 11 are aligned in the paper width direction ("one direction" of the present disclosure) which is horizontal. Note that in the following description, an explanation will be made while defining the right side and the left side in the paper width direction as depicted in FIG. 1.

Further, the four heads 11 aligned in the paper width direction and the remaining four heads 11 aligned in the paper width direction, which are included in the eight heads 11, are arranged while providing a space in the conveying direction which is horizontal and which is orthogonal to the paper width direction. Further, the four heads 11, which are positioned on the downstream side in the conveying direction and which are included in the eight heads 11, are arranged while being deviated to the right side in the paper width direction with respect to the four heads 11 which are positioned on the upstream side in the conveying direction.

Further, each of the heads 11 has four nozzle arrays 9 which are aligned in the conveying direction. Inks of black, yellow, cyan, and magenta are jetted in an order starting from those constitute the nozzle array 9 disposed on the upstream side in the conveying direction. Each of the nozzle arrays 9 has a plurality of nozzles 10. In each of the nozzle arrays 9, the plurality of nozzles 10 are arranged in the paper width direction.

Further, the eight heads 11 are arranged as described above, and thus the plurality of nozzles 10 of the eight heads 11 are arranged over the entire length of the recording paper S in the paper width direction. That is, the head unit 2 is a so-called line head. The head holder 12 is a rectangular plate-shaped member in which the paper width direction is the longitudinal direction. The head holder 12 holds the eight heads 11 in the positional relationship as described above.

The platen 3 is arranged under or below the head unit 2, and the platen 3 is opposed to the plurality of nozzles 10 of the eight heads 11. The platen 3 extends over the entire length of the recording paper S in the paper width direction, and the platen 3 supports the recording paper S from the lower position.

The conveying roller pair 4 is arranged on the upstream side in the conveying direction as compared with the head unit 2 and the platen 3. The conveying roller pair 5 is arranged on the downstream side in the conveying direction as compared with the head unit 2 and the platen 3. Each of the conveying roller pairs 4, 5 is configured by a pair of rollers which extend in the horizontal direction and which are aligned in the vertical direction. Each of the conveying roller pairs 4, 5 interposes the recording paper S by means of the pair of rollers to convey the recording paper S in the conveying direction.

Then, in the printer 1, the inks are jetted toward the recording paper S from the plurality of nozzles 10 of the eight heads 11 for constructing the head unit 2 while conveying the recording paper S in the conveying direction by means of the conveying roller pairs 4, 5, and thus it is possible to perform the recording on the recording paper S.

<Head 11>

Figure 2:
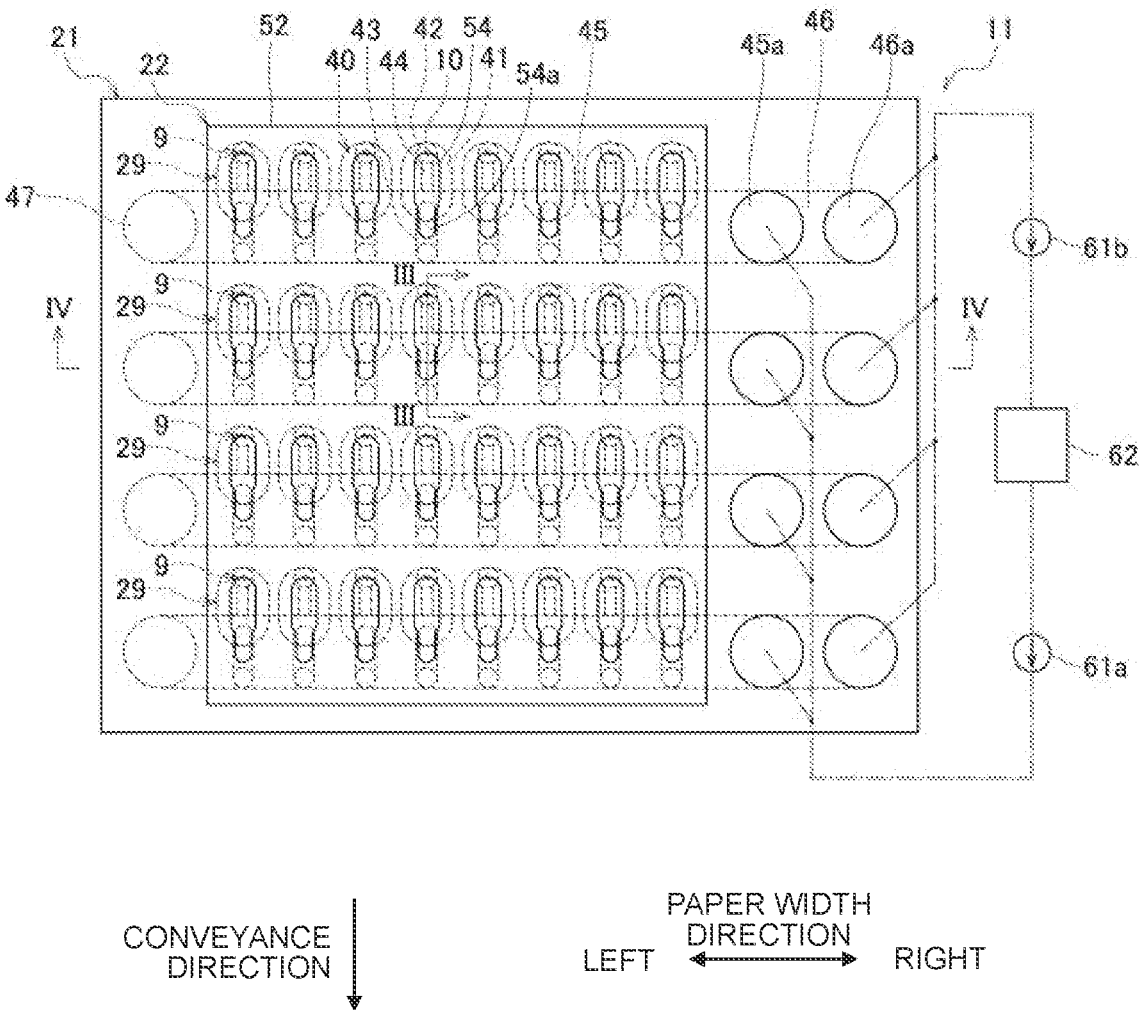
FIG. 2 is a plan view of a head 11 depicted in FIG. 1.
Figure 3:
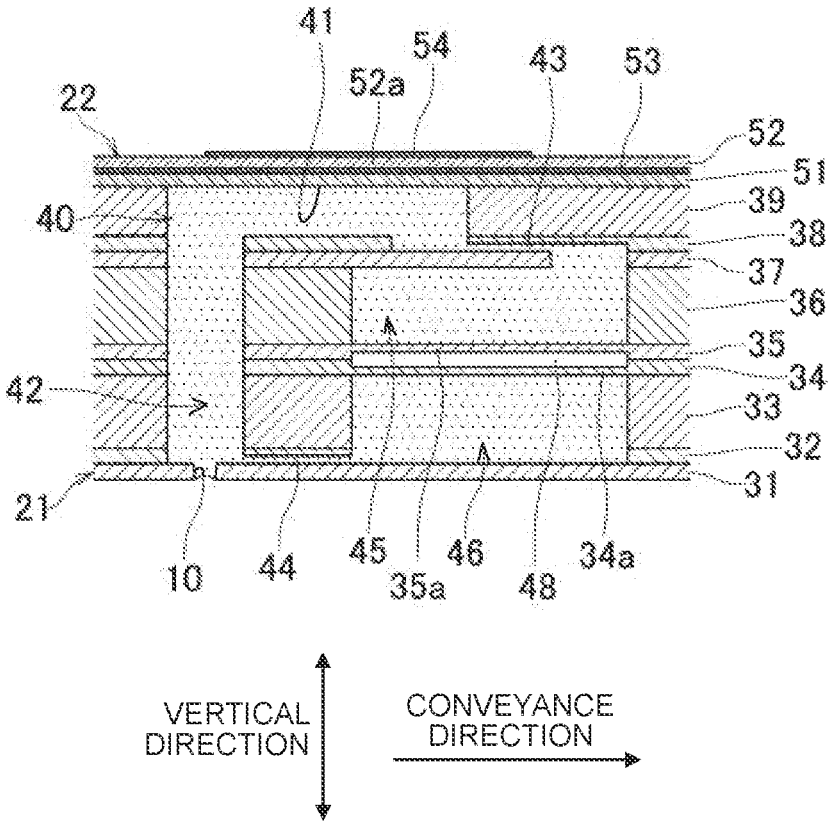
FIG. 3 is a sectional view taken along a line depicted in FIG. 2.
Figure 4:
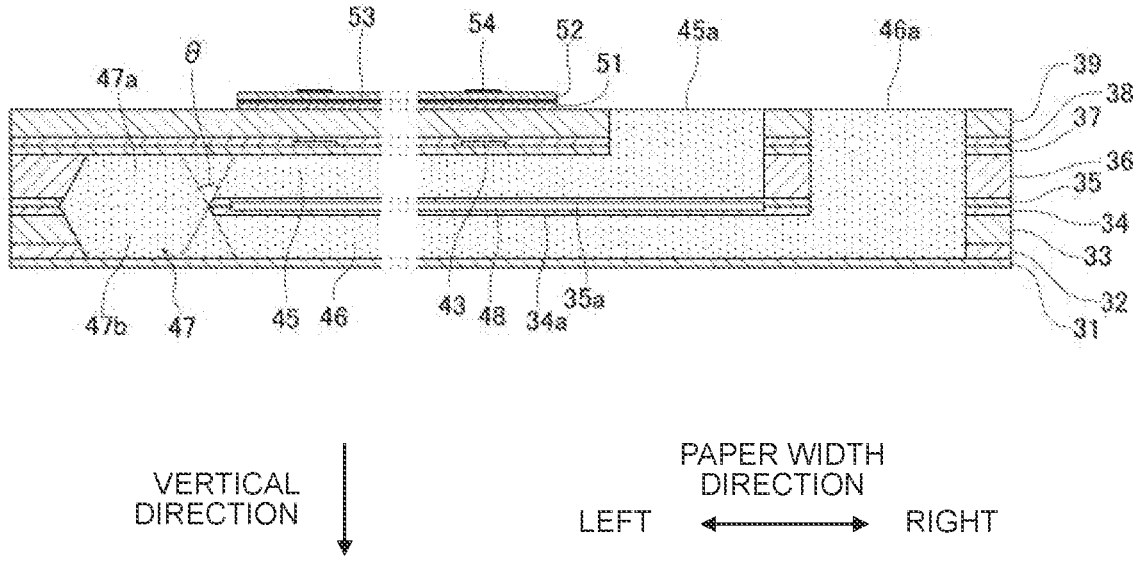
FIG. 4 is a sectional view taken along a line IV-IV depicted in FIG. 2.

Next, an explanation will be made of the structure of the head 11. As depicted in FIGS. 2 to 4, the head 11 is provided with a channel unit 21 and a piezoelectric actuator 22.

<Channel Unit 21>

The channel unit 21 is formed by stacking plates 31 to 39 in this order from the bottom. The plate 31 is formed of, for example, a synthetic resin such as polyimide or the like. Each of the plates 32 to 39 is formed of, for example, a metal material such as stainless steel or the like.

Further, the channel unit 21 has a plurality of nozzles 10, a plurality of pressure chambers 41, a plurality of descenders 42, a plurality of first throttles 43, a plurality of second throttles 44, four first manifolds 45, four second manifolds 46, and bypass channels 47.

The plurality of nozzles 10 are formed through the plate 31, and the plurality of nozzles 10 form the four nozzle arrays 9 described above.

The plurality of pressure chambers 41 are formed through the plate 39. The plurality of pressure chambers 41 are individual for the plurality of nozzles 10. Further, the pressure chamber 41 has an elliptical shape in which the conveying direction is the longitudinal direction. Further, an end portion of each of the pressure chambers 41, which is disposed on the upstream side in the conveying direction, is overlapped in the vertical direction with the corresponding nozzle 10.

The plurality of descenders 42 are formed through the plates 32 to 38. The descender 42 is provided individually for a combination of the nozzle 10 and the pressure chamber 41 which correspond to one another. The descender 42 extends in the vertical direction, and the descender 42 connects the nozzle 10 and an end portion of the corresponding pressure chamber 41 disposed on the upstream side in the conveying direction.

The plurality of first throttles 43 are formed by the plates 37, 38. The plurality of first throttles 43 will be explained in detail below. The plurality of first throttles 43 are provided individually for the plurality of pressure chambers 41. The first throttle 43 extends in the conveying direction. An end portion of the first throttle 43, which is disposed on the upstream side in the conveying direction, is overlapped in the vertical direction with an end portion of the corresponding pressure chamber 41 which is disposed on the downstream side in the conveying direction. Further, the end portion of the first throttle 43, which is disposed on the upstream side in the conveying direction, extends over the entire length of the plate 38 in the vertical direction, and the first throttle 43 is open on the upper surface of the plate 38. Accordingly, the end portion of the first throttle 43, which is disposed on the upstream side in the conveying direction, is connected to the end portion of the corresponding pressure chamber 41 which is disposed on the downstream side in the conveying direction. Further, the end portion of the first throttle 43, which is disposed on the downstream side in the conveying direction, extends over the entire length of the plate 33 and the lower portion of the plate 32 in the vertical direction, and the first throttle 43 is open on the lower surface of the plate 33.

The plurality of second throttles 44 are formed at lower portions of the plate 32. The plurality of second throttles 44 are provided individually for the plurality of descenders 42. The second throttle 44 is connected to the end on the downstream side in the conveying direction of the lower end portion of the corresponding descender 42. The second throttle 44 extends to the downstream side in the conveying direction from the connecting portion with respect to the descender 43.

Then, in the channel unit 21, one individual channel 40 is formed by the nozzle 10, the pressure chamber 41, the descender 42, the first throttle 43, and the second throttle 44 which correspond to one another. Further, as described above, corresponding to the four nozzle arrays 9 possessed by the head 11 as described above, the individual channel arrays 29, which are formed by arranging the plurality of individual channels 40 in the paper width direction, are aligned in four arrays in the channel unit 21.

The four first manifolds 45 are formed by the plate 36. The four first manifolds 45 correspond to the four individual channel arrays 29. Each of the first manifolds 45 extends in the paper width direction over the plurality of individual channels 40 which construct the corresponding individual channel array 29. Further, the end portion of each of the first manifolds 45, which is disposed on the downstream side in the conveying direction, is overlapped in the vertical direction with the end portions disposed on the downstream side in the conveying direction of the first throttles 43 of the plurality of individual channels for constructing the corresponding individual channel array 29. Accordingly, each of the first manifolds 45 is connected to the end portions disposed on the downstream side in the conveying direction of the first throttles 43 of the plurality of individual channels for constructing the corresponding individual channel array 29.

Further, each of the first manifolds 45 extends in the vertical direction to range over the plates 36 to 39 and a vibration plate 51 arranged on the upper surface of the plate 39 as described later on at the right end portion in the paper width direction ("end portion disposed on one side in one direction" of the present disclosure). The upper end thereof is a supply port 45*a* which is open on the upper surface of the vibration plate 51.

The four second manifolds 46 are formed by the plates 32, 33. The four second manifolds 46 correspond to the four individual channel arrays 29. Each of the second manifolds 46 extends in the paper width direction over the plurality of individual channels 40 for constructing the corresponding individual channel array 29. Each of the second manifolds 46 is overlapped in the vertical direction with the first manifold 45 which corresponds to the same individual channel array 29. Then, each of the second manifolds 46 is connected to the end disposed on the downstream side in the conveying direction of the second throttles 44 of the plurality of individual channels 40 for constructing the corresponding individual channel array 29.

Further, each of the second flow passages 46 further extends to the right side as compared with the right end of the first manifold 45 in the paper width direction. Further, each of the second manifolds 46 extends in the vertical direction over the plates 32 to 39 and the vibration plate 51 as described later on at the right end portion in the paper width direction. The upper end thereof is a discharge port 46*a* which is open on the upper surface of the vibration plate 51.

Further, a damper chamber 48 is formed at portions of the plates 34, 35 overlapped in the vertical direction with the first manifold 45 and the second manifold 46. The damper chamber 48 is a space formed by a recess which is formed at an upper portion of the plate 34 and a recess which is formed at a lower portion of the plate 35. Then, the portion of the plate 35, which is positioned between the first manifold 45 and the damper chamber 48, is a damper 35*a* which suppresses the pressure fluctuation of the ink contained in the first manifold 45 by being elastically deformed. Further, the portion of the plate 34, which is positioned between the second manifold 46 and the damper chamber 48, is a damper 34*a* which suppresses the pressure fluctuation of the ink contained in the second manifold 46 by being elastically deformed.

The bypass channel 47 is formed to range over the plates 33 to 36. The bypass channel 47 has a first flow passage portion 47*a* and a second flow passage portion 47*b*.

The first flow passage portion 47*a* is formed to range over the plates 35, 36. The first flow passage portion 47*a* has its upper end portion which is connected to the left end portion in the paper width direction of the first manifold 45 ("end portion disposed on the other side in one direction" of the present disclosure). Further, the first flow passage portion 47*a* extends while being inclined with respect to the vertical direction so that the first flow passage portion 47*a* advances to the left side in the paper width direction at positions at which the first flow passage portion 47*a* advances more downwardly.

The second flow passage portion 47*b* is formed to range over the plates 33, 34. The second flow passage portion 47*b* extends while being inclined with respect to the vertical direction so that the second flow passage portion 47*b* advances to the right side in the paper width direction at positions at which the second flow passage portion 47*b* advances more downwardly. The second flow passage portion 47*b* connects the lower end of the first flow passage portion 47*a* and the left end portion in the paper width direction of the second manifold 46 ("end portion disposed on the other side in one direction" of the present disclosure).

Accordingly, the left end portion in the paper width direction of the first manifold 45 and the left end portion in the paper width direction of the second manifold 46 are connected to one another by the aid of the bypass channel 47. Further, in the bypass channel 47, the angle formed by the direction in which the first flow passage portion 47*a* extends and the direction in which the second flow passage portion 47*b* extends, i.e., the bending angle θ between the first flow passage portion 47*a* and the second flow passage portion 47*b* is about 40°.

Further, the supply port 45*a* of each of the four first manifolds 45 is connected to a pump 61*a* via an unillustrated tube or the like. The pump 61*a* is connected to an ink tank 62, and the pump 61*a* feeds the ink from the ink tank 62 toward the supply port 45*a*. The discharge port 46*a* of each of the four second manifold 46 is connected to a pump 61*b* via an unillustrated tube or the like. The pump 61*b* is connected to the ink tank 62, and the pump 61*b* feeds the ink from the discharge port 46*a* toward the ink tank 62.

Then, when the ink is fed as described above by driving the pumps 61*a*, 61*b*, the ink contained in the ink tank 62 flows into the first manifold 45 from the supply port 45*a*. The ink contained in the first manifold 45 flows through the plurality of corresponding individual channels 40 in an order of the first throttle 43, the pressure chamber 41, the descender 42, and the second throttle 44. The ink flows into the corresponding second manifold 46. Further, the ink contained in the first manifold 45 flows into the second manifold 46 via the bypass channel 47 as well. The ink contained in the second manifold 46 outflows from the discharge port 46*a*, and the ink returns to the ink tank 62. In this way, in this embodiment, it is possible to circulate the ink between the head 11 and the ink tank 62.

Further, in this embodiment, as described above, the pumps 61*a*, 61*b* are provided between the supply port 45*a* and the ink tank 62 and between the discharge port 46*a* and the ink tank 62 respectively. However, only one of the pumps 61*a*, 61*b* may be provided. Even in this case, it is possible to circulate the ink between the head 11 and the ink tank 62 in the same manner as described above by driving one pump.

<Piezoelectric Actuator 22>

The piezoelectric actuator 22 has the vibration plate 51, a piezoelectric layer 52, a common electrode 53, and a plurality of individual electrodes 54.

The vibration plate 51 is formed of a piezoelectric material containing a main component of lead zirconate titanate as a mixed crystal of lead titanate and lead zirconate. The vibration plate 51 is arranged on the upper surface of the channel unit 21 (plate 39), and the vibration plate 51 covers the plurality of pressure chambers 41. Further, as described above, the first manifold 45 and the second manifold 46 extend to the vibration plate 51 at the right end portions in the paper width direction. The supply port 45*a* of the first manifold 45 and the discharge port 46*a* of the second manifold 46 are open on the upper surface of the vibration plate 51. Note that the vibration plate 51 may be formed of a piezoelectric material which is the same as or equivalent to that of the piezoelectric layer 52 explained below. The vibration plate 51 may be formed of an insulating material other than the piezoelectric material, including, for example, a synthetic resin material.

The piezoelectric layer 52 is formed of a piezoelectric material. The piezoelectric layer 52 is arranged on the upper surface of the vibration plate 51, and the piezoelectric layer 52 continuously extends over the plurality of pressure chambers 41. The common electrode 53 extends between the vibration plate 51 and the piezoelectric layer 52 over the entire region thereof. The common electrode 53 is connected to an unillustrated power source, and the common electrode 53 is retained at the ground electric potential.

The plurality of individual electrodes 54 are arranged on the upper surface of the piezoelectric layer 52. The plurality of individual electrodes 54 are provided individually with respect to the plurality of pressure chambers 41. The individual electrode 54 is overlapped in the vertical direction with the central portion of the corresponding pressure chamber 41. Further, each of the individual electrodes 54 extends to the position at which the individual electrode 54 is not overlapped in the vertical direction with the pressure chamber 41 on the downstream side in the conveying direction. The forward end portion thereof is a contact portion 54*a*. The contact portion 54*a* is connected to unillustrated driver IC via an unillustrated wiring member. The driver IC selectively applies any one of the ground electric potential and a predetermined driving electric potential (for example, about 20 V) to the individual electrode 54.

Further, the portion of the piezoelectric layer 52, which is interposed between each of the individual electrodes 54 and the common electrode 53, is an active portion 52*a* which is polarized in the vertical direction, corresponding to the arrangement of the common electrode 53 and the plurality of individual electrodes 54 as described above.

In this context, in the piezoelectric actuator 22, any electric potential difference does not arise between the individual electrode 54 and the common electrode 53 in the state in which the ground electric potential is applied to the individual electrode 54. The portions of the vibration plate 51 and the piezoelectric layer 52 overlapped in the vertical direction with the pressure chamber 41 are in the flat state. In the state in which the driving electric potential is applied to the individual electrode 54, the electric field, which is parallel to the polarization direction, is generated in the active portion 52*a* on account of the electric potential difference between the individual electrode 54 and the common electrode 53. In accordance with the electric field, the active portion 52*a* is shrunk in the directions (paper width direction and conveying direction) orthogonal to the polarization direction. As a result, the portions of the vibration plate 51 and the piezoelectric layer 52 overlapped in the vertical direction with the pressure chamber 41 are deformed so that they protrude toward the pressure chamber 41.

Then, in the piezoelectric actuator 22, the electric potential of the individual electrode 54 is switched between the ground electric potential and the driving electric potential to deform the portions of the vibration plate 51 and the piezoelectric layer 52 overlapped in the vertical direction with the pressure chamber 41. Thus, the volume of the pressure chamber 41 is changed, and the pressure of the ink contained in the pressure chamber 41 is changed. Accordingly, it is possible to jet the ink from the nozzle 10 communicated with the pressure chamber 41.

Further, in this embodiment, it is possible to jet three types of ink composed of large droplets, middle droplets, and small droplets from the nozzle 10 by allowing the driving waveform to differ in order to switch the electric potential of the individual electrode 54 between the ground electric potential and the driving electric potential. The volume of the middle droplet is larger than that of the small droplet, and the volume of the large droplet is larger than that of the middle droplet.

<Relationship of Flow Channel Resistances in Channel Unit 21>

In this embodiment, the flow channel resistance Rct brought about by the plurality of individual channels 40 connected to a pair of the first manifold 45 and the second manifold 46, the flow channel resistance Rbp of the bypass channel 47, the bending loss ΔP provided when the ink flows from the first manifold 45 via the bypass channel 47 to the second manifold 46, and the flow rate Q of the ink flowing through the bypass channel 47 fulfill a relationship of:

$$0.5<[Rct/(Rbp+(\Delta P/Q))]<2.0.$$

In this context, assuming that the flow channel resistance of one individual channel 40 is represented by Rc, and the number of the individual channels 40 connected to the pair of the first manifold 45 and the second manifold 46 is represented by N, the flow channel resistance Rct is calculated by Rct=(Rc/N).

Further, in this embodiment, the bending loss ΔP is calculated by $\Delta P=(\rho\times g\times h)$. In this context, the loss head h [m] is calculated by $h=\zeta\times(u^2/(2\times g))$ by using the loss coefficient ζ, the fluid density of the ink ρ [$kg\cdot m^3$], the gravitational acceleration g [$m/s^2$], and the flow rate of the liquid u [m/s]. Note that the loss coefficient ζ is calculated by $\zeta=[(0.946\times\sin^2(\theta/2))+(2.05\times\sin^4(\theta/2))]$.

Further, in this embodiment, the pumps 61*a*, 61*b* are driven in relation to the first manifold 45, the second manifold 46, the plurality of individual channels 40, and the bypass channel 47 which correspond to one another so that the total circulation flow rate, which is the total of the flow rates of the ink flowing from the first manifold 45 to the second manifold 46 via the plurality of individual channels 40 and the bypass channel 47 respectively, is larger than the total unit time jetting amount as the total of the jetting amounts of the ink jetted from the nozzles 10 per unit time when the large droplets are jetted (ink is maximally jetted) from all of the nozzles 10 for constructing the plurality of individual channels 40.

Further, in this embodiment, the viscosity of the ink is in a range of 7.0 to 8.0 [cps]. On the other hand, in this embodiment, the flow channel resistance Rct is in a range of 300 to 400 [kPa/cc/sec]. Further, the flow channel resistance Rbp is in a range of 200 to 300 [kPa/cc/sec]. Further, the pumps 61*a*, 61*b* are driven so that the flow rate Q is in a range of 0.01 to 0.1 [cc/sec], and (ΔP/Q) is in a range of 10 to 20 [kPa/cc/sec].

<Effect of Embodiment>

Such a case is now assumed that the influence of the bending loss ΔP is not considered, and only the flow channel resistance Rct and the flow channel resistance Rbp are considered unlike this embodiment. For example, it is assumed that the flow passages are formed so that a relationship of 0.5<(Rct/Rbp)<2.0 is fulfilled. In this case, if the bending loss ΔP is large, the ink hardly flows from the first manifold 45 to the second manifold 46 via the bypass channel 47. As a result, it is feared that a great difference may appear between the flow rate of the ink flowing from the first manifold 45 to the second manifold 46 via the plurality of individual channels 40 and the flow rate of the ink flowing from the first manifold 45 to the second manifold 46 via the bypass channel 47.

Note that the bending loss also exists in the individual channel 40. However, the flow rate of the ink flowing through each of the individual channels 40 is sufficiently smaller than the flow rate of the ink flowing through the bypass channel 47. Therefore, the bending loss in the individual channel 40 is small to such an extent that the bending loss in the individual channel 40 can be neglected as compared with the bending loss in the bypass channel 47.

In view of the above, in this embodiment, the flow passages are formed so that the relationship of $0.5<[Rct/(Rbp+(\Delta P/Q))]<2.0$ is fulfilled while considering the influence of the bending loss $\Delta P$ as well in addition to the flow channel resistance Rct and the flow channel resistance Rbp. Accordingly, it is possible to uniformize the flow rate of the ink flowing from the first manifold 45 to the second manifold 46 via the plurality of individual channels 40 and the flow rate of the ink flowing from the first manifold 45 to the second manifold 46 via the bypass channel 47.

Further, in this embodiment, the supply port 45*a* and the discharge port 46*a* are provided respectively at the right end portions in the paper width direction of the first manifold 45 and the second manifold 46. The bypass channel 47 connects the left end portion in the paper width direction of the first manifold 45 and the left end portion in the paper width direction of the second manifold 46. In the configuration as described above, when the ink is circulated between the head 11 and the ink tank 62, the direction of the flow of the ink in the first manifold 45 is opposite to that in the second manifold 46. On this account, when the ink flows from the first manifold 45 to the second manifold 46 via the bypass channel 47, then the direction of the flow of the ink is greatly changed, and the bending loss $\Delta P$ is increased. Therefore, in this embodiment, it is greatly significant to fulfill the relationship of $0.5<[Rct/(Rbp+(\Delta P/Q))]<2.0$, while considering the influence of the bending loss $\Delta P$ in addition to the flow channel resistance Rct and the flow channel resistance Rbp.

Further, in this embodiment, the bypass channel 47 has the first flow passage portion 47*a* and the second flow passage portion 47*b*. The bending angle $\theta$ between the first flow passage portion 47*a* and the second flow passage portion 47*b* is about 40°. The flow passage is bent relatively greatly between the first flow passage portion 47*a* and the second flow passage portion 47*b*. In this case, the large bending loss arises when the ink flows through the bypass channel 47. Therefore, in this embodiment, it is greatly significant to fulfill the relationship of $0.5<[Rct/(Rbp+(\Delta P/Q))]<2.0$, while considering the influence of the bending loss $\Delta P$ in addition to the flow channel resistance Rct and the flow channel resistance Rbp.

Further, in this embodiment, the pumps 61*a*, 61*b* are driven so that the total circulation flow rate is larger than the total unit time jetting amount respectively in the first manifold 45, the second manifold 46, and the plurality of individual channels 40 which correspond to one another. Therefore, in this embodiment, the rate of decrease is small in relation to the flow rate of the ink flowing through the bypass channel 47 when the ink is jetted from the nozzle 10. Accordingly, it is possible to decrease the change of the bending loss $\Delta P$ in the bypass channel 47 as caused by the ink jetted from the nozzle 10.

Further, in this embodiment, the viscosity of the ink is in the range of 7.0 to 8.0 [cps], wherein the viscosity of the ink is relatively small. In this case, the influence is large, which is exerted by the bending loss $\Delta P$ in the bypass channel 47 on the easiness of the flow of the ink from the first manifold 45 to the second manifold 46 via the bypass channel 47. Therefore, in this embodiment, it is greatly significant to fulfill the relationship of $0.5<[Rct/(Rbp+(\Delta P/Q))]<2.0$, while considering the influence of the bending loss $\Delta P$ in addition to the flow channel resistance Rct and the flow channel resistance Rbp.

Further, in this embodiment, the flow rate of the ink flowing through the bypass channel 47 is in the range of 0.01 to 0.1 [cc/sec]. When the flow rate of the ink is in the range as described above, it is easy to adjust the flow rate of the ink in the bypass channel 47 to be a desired flow rate by means of the pumps 61*a*, 61*b*.

Further, in this embodiment, when the viscosity of the ink is in the range of 7.0 to 8.0 [cps], then the flow channel resistance Rct is in the range of 300 to 400 [kPa/cc/sec], the flow channel resistance Rbp is in the range of 200 to 300 [kPa/cc/sec], and $(\Delta P/Q)$ is in the range of 10 to 20 [kPa/cc/sec]. When the viscosity of the ink is in the range of 7.0 to 8.0 [cps], if Rct, Rbp, $(\Delta P/Q)$ are in the ranges as described above, then the relationship of $0.5<[Rct/(Rbp+(\Delta P/Q))]<2.0$ is fulfilled. Accordingly, it is possible to uniformize the flow rate of the ink flowing from the first manifold 45 to the second manifold 46 via the plurality of individual channels 40 and the flow rate of the ink flowing from the first manifold 45 to the second manifold 46 via the bypass channel 47.

Further, in this embodiment, assuming that the bending angle is represented by $\theta$, the loss coefficient calculated by $\zeta=[(0.946\times\sin^2(\theta/2))+(2.05\times\sin^4(\theta/2))]$ is represented by $\zeta$, the fluid density of the liquid is represented by $\rho$ [$kg\cdot m^3$], the gravitational acceleration is represented by g [$m/s^2$], the flow rate of the liquid is represented by u [m/s], and the loss head calculated by $h=\zeta\times(u^2/(2\times g))$ is represented by h [m], the bending loss $\Delta P$ is the value calculated by $\Delta P=(\rho\times g\times h)$. Accordingly, it is possible to accurately calculate the bending loss $\Delta P$.

Modified Embodiments

The preferred embodiment of the present disclosure has been explained above. However, the present disclosure is not limited to the embodiment described above, for which various changes or modifications can be made within a scope defined in claims.

In the embodiment described above, the bending loss $\Delta P$ is calculated as $\Delta P=(\rho\times g\times h)$. However, there is no limitation thereto. The bending loss $\Delta P$ may be, for example, either calculated by any other method or obtained by any experiment.

Further, in the embodiment described above, the viscosity of the ink is in the range of 7.0 to 8.0 [cps], while the flow channel resistance Rct is in the range of 300 to 400 [kPa/cc/sec], the flow channel resistance Rbp is in the range of 200 to 300 [kPa/cc/sec], and $(\Delta P/Q)$ is in the range of 10 to 20 [kPa/cc/sec]. However, there is no limitation thereto. For example, when the viscosity of the ink is in the range of 7.0 to 8.0 [cps], at least one or some of the flow channel resistance Rct, the flow channel resistance Rbp, and $(\Delta P/Q)$ may be deviated from the ranges described above, provided that the deviation is in a range to fulfill the relationship of $0.5<[Rct/(Rbp+(\Delta P/Q))]<2.0$.

Further, in the embodiment described above, the pumps 61*a*, 61*b* are driven so that the flow rate Q is in the range of 0.01 to 0.1 [cc/sec]. However, there is no limitation thereto. The pumps 61*a*, 61*b* may be driven so that the flow rate Q is less than 0.01 [cc/sec], or the flow rate Q is larger than 0.1 [cc/sec].

Further, in the embodiment described above, the viscosity of the ink is in the range of 7.0 to 8.0 [cps]. However, there is no limitation thereto. The viscosity may be less than 7.0 [cps], or the viscosity may be larger than 8.0 [cps], provided that the viscosity of the ink is in a range of 2 to 14 [cps]. Even in this case, the viscosity of the ink is relatively low. Therefore, it is greatly significant to fulfill the relationship of $0.5<[Rct/(Rbp+(\Delta P/Q))]<2.0$, while considering the influence of the bending loss ΔP in addition to the flow channel resistance Rct and the flow channel resistance Rbp in the same manner as explained in the embodiment described above.

Alternatively, the viscosity of the ink may be less than 2 [cps], or the viscosity of the ink may be larger than 14 [cps].

Further, in the embodiment described above, the pumps 61*a*, 61*b* are driven so that the total circulation flow rate is larger than the total unit time jetting amount respectively in the first manifold 45, the second manifold 46, the plurality of individual channels 40, and the bypass channel 47 which correspond to one another. However, there is no limitation thereto.

The pumps 61*a*, 61*b* may be driven so that the total circulation flow rate is not more than the total unit time jetting amount in relation to the first manifold 45, the second manifold 46, the plurality of individual channels 40, and the bypass channel 47 which correspond to one another.

Further, in the embodiment described above, the first manifold 45 and the second manifold 46 are overlapped with each other in the vertical direction. However, there is no limitation thereto.

Figure 5:
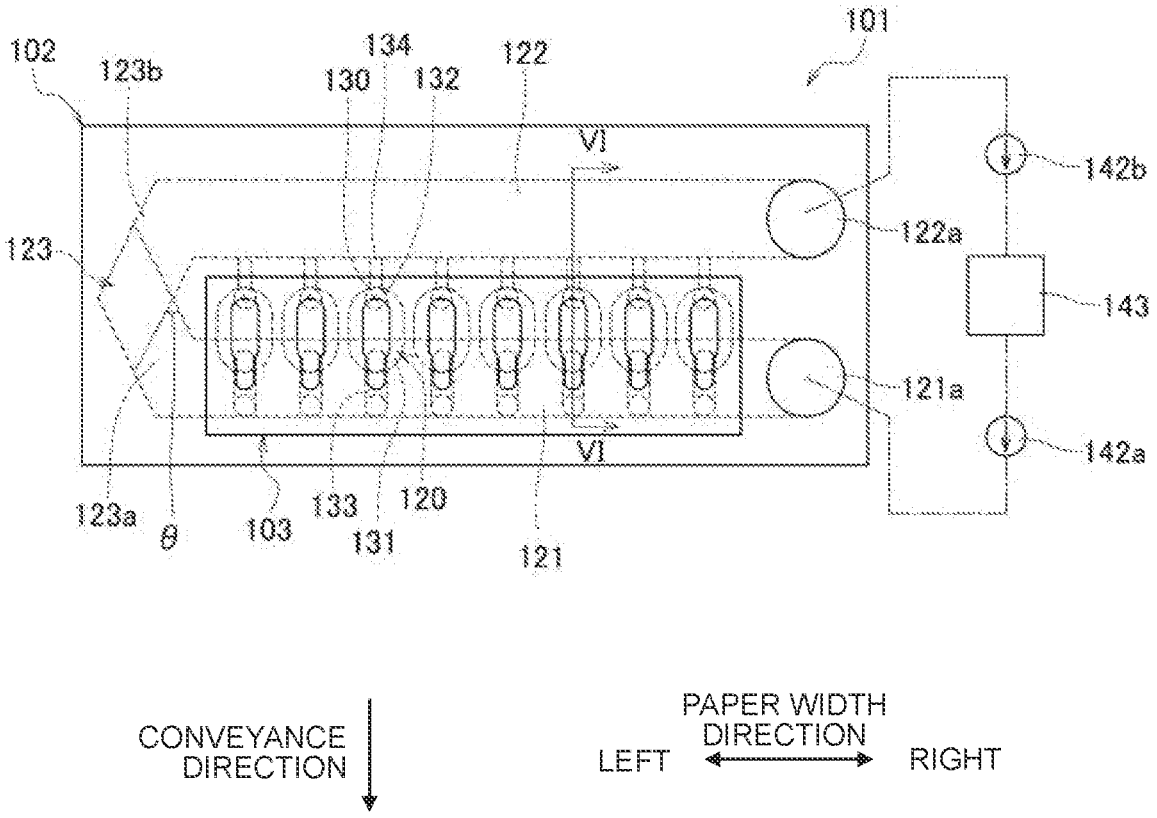
FIG. 5 is a plan view of a head 101.
Figure 6:
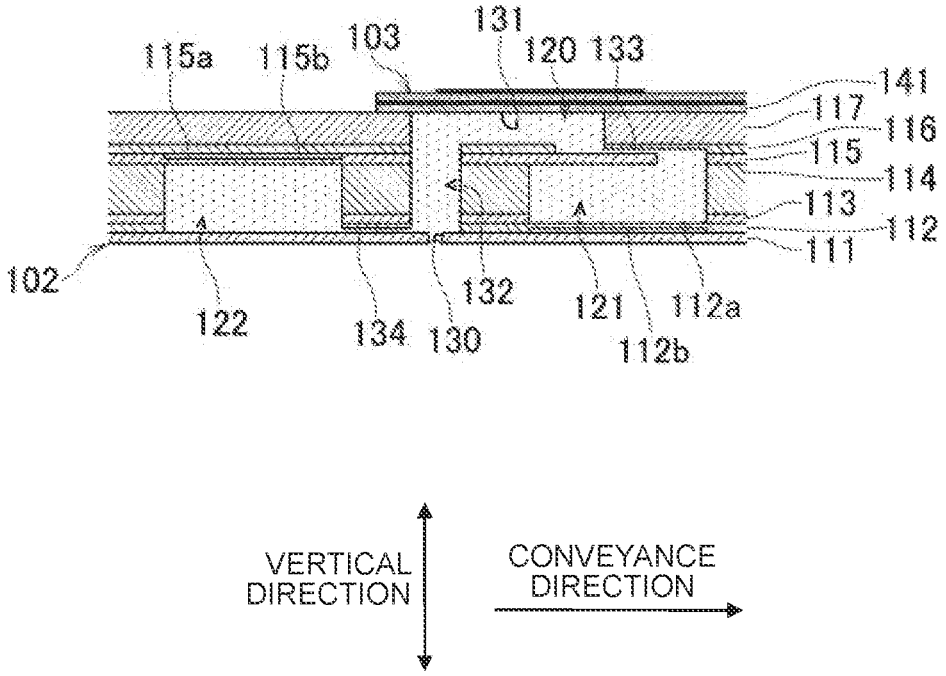
FIG. 6 is a sectional view taken along a line VI-VI depicted in FIG. 5.

In a first modified embodiment, as depicted in FIGS. 5 and 6, a head 101 has a channel unit 102 and a piezoelectric actuator 103.

The channel unit 102 is formed by stacking plates 111 to 117 in the vertical direction in this order from the bottom. Further, the channel unit 102 is formed with a plurality of individual channels 120, a first manifold 121, a second manifold 122, and a bypass channel 123.

The plurality of individual channels 120 are arranged in the paper width direction. Each of the individual channels 120 is formed by a nozzle 130, a pressure chamber 131, a descender 132, a first throttle 133, and a second throttle 134. The nozzle 130, the pressure chamber 131, the descender 132, and the first throttle 133 are the flow passages having the shapes which are the same as or equivalent to those of the nozzle 10, the pressure chamber 41, the descender 42, and the first throttle 43 of the embodiment described above respectively. However, in the first modified embodiment, unlike the embodiment described above, the nozzle 130 is formed through the plate 111. Further, the pressure chamber 131 is formed by the plate 117. Further, the descender 132 is formed to range over the plates 112 to 116. The length of the descender 132 in the vertical direction is shorter than that of the descender 42. Further, the first throttle 133 is formed to range over the plates 115, 116.

The second throttle 134 is formed at a lower portion of the plate 112. The second throttle 134 is connected to the end disposed on the upstream side in the conveying direction of the lower end portion of the descender 132. The second throttle 134 extends to the upstream side in the conveying direction from the connecting portion with respect to the descender 132.

The first manifold 121 is formed to range over the plates 113, 114. The first manifold 121 extends in the paper width direction over the plurality of individual channels 120, and the first manifold 121 is connected to the first throttles 133 of the plurality of individual channels 120 in the same manner as the first manifold 45 of the embodiment described above.

Further, the first manifold 121 extends in the vertical direction over the plates 113 to 117 at the right end portion in the paper width direction ("end portion disposed on one side in one direction" of the present disclosure). The upper end thereof is a supply port 121*a* which is open on the upper surface of the plate 117. A pump 142*a* is connected to the supply port 121*a*. The pump 142*a* is connected to an ink tank 143. The ink is fed from the ink tank 143 to the supply port 121*a*.

Further, a recess 112*a* is formed at a portion overlapped in the vertical direction with the first manifold 121, the portion being included in a lower portion of the plate 112. Accordingly, the portion of the plate 112, which is disposed between the first manifold 121 and the recess 112*a*, is a damper 112*b* which is elastically deformable to suppress the pressure fluctuation of the ink contained in the first manifold 121.

The second manifold 122 is formed to range over the plates 112 to 114. The second manifold 122 is positioned on the upstream side in the conveying direction as compared with the plurality of individual channels 120. The second manifold 122 extends in the paper width direction over the plurality of individual channels 120. The second manifold 122 are connected to the ends of the second throttles 134 of the plurality of individual channels 120 disposed on the upstream side in the conveying direction.

Further, the second manifold 122 extends in the vertical direction over the plates 112 to 117 at the right end portion in the paper width direction ("end portion disposed on one side in one direction" of the present disclosure). The upper end thereof is a discharge port 122*a* which is open on the upper surface of the plate 117. A pump 142*b* is connected to the discharge port 122*a*. The pump 142*b* is connected to the ink tank 143. The ink is fed from the discharge port 122*a* to the ink tank 143.

Further, a recess 115*a* is formed at a portion overlapped in the vertical direction with the second manifold 122, the portion being included in an upper portion of the plate 115. Accordingly, the portion of the plate 115, which is disposed between the second manifold 122 and the recess 115*a*, is a damper 115*b* which is elastically deformable to suppress the pressure fluctuation of the ink contained in the second manifold 122.

The bypass channel 123 is formed by the plate 114. The bypass channel 123 has a first flow passage portion 123*a* and a second flow passage portion 123*b*.

The first flow passage portion 123*a* is connected to the left end portion in the paper width direction of the first manifold 121 ("end portion disposed on the other side in one direction" of the present disclosure). Further, the first flow passage portion 123*a* extends while being inclined with respect to the conveying direction so that the first flow passage portion 123*a* advances to the left side in the paper width direction at positions at which the first flow passage portion 123*a* advances to the more upstream side in the conveying direction.

The second flow passage portion 123*b* extends while being inclined in the conveying direction so that the second flow passage portion 123*b* advances to the right side in the paper width direction at positions at which the second flow passage portion 123*b* advances to the more upstream side in the conveying direction. The second flow passage portion 123*b* connects the end on the upstream side in the conveying direction of the first flow passage portion 123*a* and the left end portion in the paper width direction of the second manifold 122 ("end portion disposed on one side in one direction" of the present disclosure).

Accordingly, the left end portion in the paper width direction of the first manifold 121 and the left end portion in the paper width direction of the second manifold 122 are connected to one another via the bypass channel 123. Further, as for the bypass channel 123, the angle, which is formed by the direction in which the first flow passage portion 123*a* extends and the direction in which the second flow passage portion 123*b* extends, i.e., the bending angle θ between the first flow passage portion 123*a* and the second flow passage portion 123*b* is about 40°.

The piezoelectric actuator 103 is the same as or equivalent to the portion of the piezoelectric actuator 22 of the embodiment described above, the portion corresponding to one individual channel array 29.

Note that the head 101 concerning the first modified embodiment jets one color ink, and the head unit, which is configured by the head 101, also jets one color ink. When a printer is configured by the head unit which jets the one color ink, then the four head units are arranged and aligned, for example, in the conveying direction, and black, yellow, cyan, and magenta inks are jetted in this order by those starting from one positioned on the upstream side in the conveying direction. Accordingly, the printer can perform the recording by using the four color inks.

Further, in the embodiment and the first modified embodiment described above, the bending angle θ between the first flow passage portion and the second flow passage portion of the bypass channel is about 40°. However, there is no limitation thereto. For example, the bending angle θ may be larger than 40°. On the other hand, the bending angle θ may be smaller than 40°.

Further, there is no limitation to such configuration that the bypass channel has the first flow passage portion and the second flow passage portion, and the flow passage is bent between the first flow passage portion and the second flow passage portion. For example, the bypass channel may be a flow passage which extends while being bent continuously along a curve such as a circular arc or the like.

Further, in the exemplary case described above, the supply port and the discharge port are provided respectively at the end portions disposed on one side in the length direction of the first manifold and the second manifold, and the bypass channel mutually connects the end portions disposed on the other side in the length direction of the first manifold and the second manifold. However, there is no limitation thereto.

Figure 7:
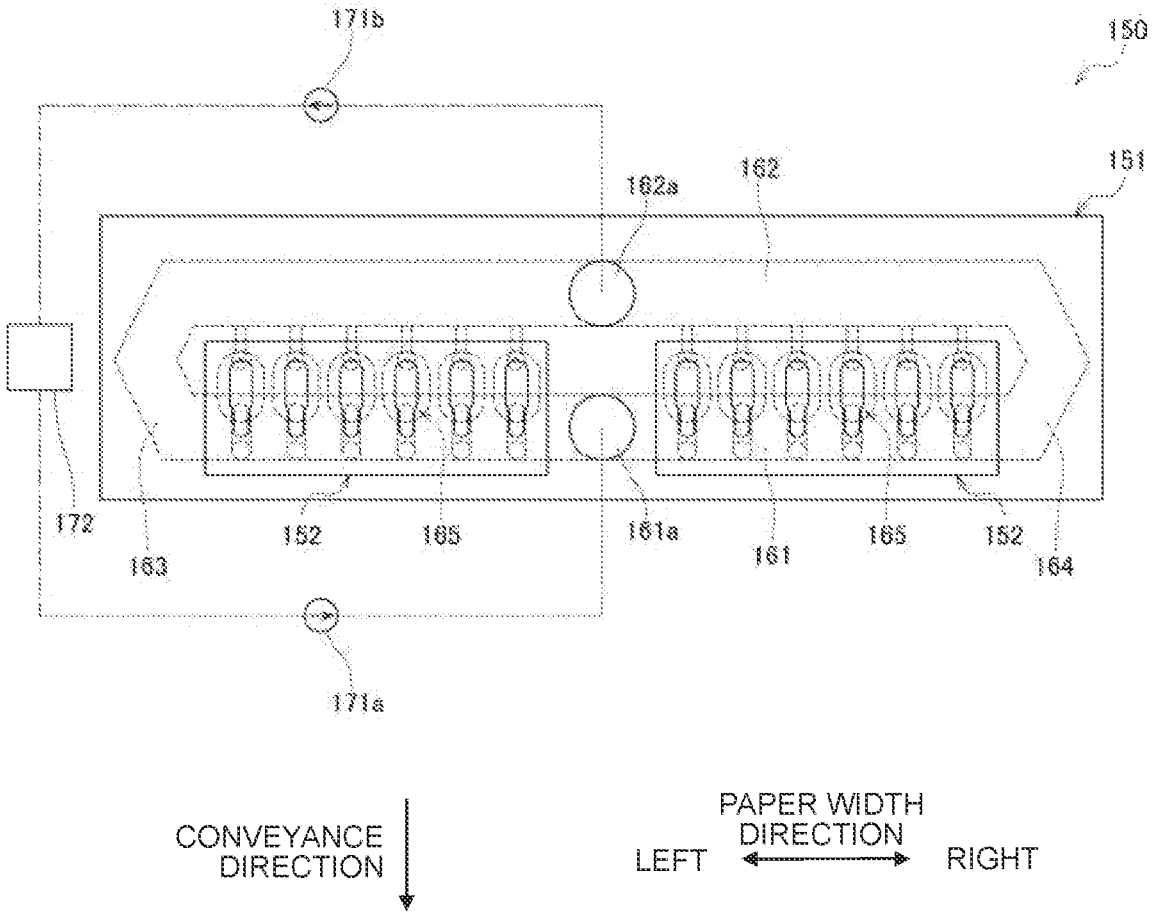
FIG. 7 is a plan view of a head 150.

In a second modified embodiment, as depicted in FIG. 7, a channel unit 151 of a head 150 is provided with a first manifold 161 and a second manifold 162 which extend in the paper width direction. The first manifold 161 and the second manifold 162 are arranged while providing a space in the conveying direction. The second manifold 162 is positioned on the upstream side in the conveying direction as compared with the first manifold 161. Further, a supply port 161*a* is provided at a central portion in the paper width direction of the first manifold 161. Further, a discharge port 162*a* is provided at a central portion in the paper width direction of the second manifold 162.

A pump 171*a* is connected to the supply port 161*a*. The pump 171*a* is connected to an ink tank 172. The ink is fed from the ink tank 172 to the supply port 161*a*. A pump 171*b* is connected to the discharge port 162*a*. The pump 171*b* is connected to the ink tank 172. The ink is fed from the discharge port 162*a* to the ink tank 172.

Further, the channel unit 151 is provided with two bypass channels 163, 164. The bypass channel 163 connects the left end portion in the paper width direction of the first manifold 161 and the left end portion in the paper width direction of the second manifold 162. Further, the bypass channel 163 is the flow passage having the shape which is the same as or equivalent to that of the bypass channel 123 of the first modified embodiment.

The bypass channel 164 connects the right end portion in the paper width direction of the first manifold 161 and the right end portion in the paper width direction of the second manifold 162. Further, the bypass channel 164 is the flow passage having the shape which is symmetrical with that of the bypass channel 163 in relation to the axis parallel to the conveying direction.

Further, a plurality of individual channels 165, which are arranged in the paper width direction, are provided at a portion disposed between the supply port 161*a* and the discharge port 162*a* and the bypass channel 163 in the paper width direction of the channel unit 151. Similarly, a plurality of individual channels 165, which are arranged in the paper width direction, are provided at a portion disposed between the supply port 161*a* and the discharge port 162*a* and the bypass channel 164 in the paper width direction. The individual channel 165 is the flow passage which is the same as or equivalent to the individual channel 120 of the first modified embodiment. The individual channel 165 is connected to the first manifold 161 and the second manifold 162.

Further, corresponding thereto, the head 150 includes piezoelectric actuators 152 which are arranged respectively on a portion of the upper surface of the channel unit 151 disposed between the supply port 161*a* and the discharge port 162*a* and the bypass channel 163 and on a portion disposed between the supply port 161*a* and the discharge port 162*a* and the bypass channel 164. Each of the piezoelectric actuators 152 is the same as or equivalent to the piezoelectric actuator 103 of the first modified embodiment.

Then, in the second modified embodiment, the flow channel resistance Rct1 brought about by the plurality of individual channels 165 disposed between the supply port 161*a* and the discharge port 162*a* and the bypass channel 163, the flow channel resistance Rbp1 of the bypass channel 163, the bending loss ΔP1 provided when the ink flows from the first manifold 161 via the bypass channel 163 to the second manifold 162, and the flow rate Q1 of the ink flowing through the bypass channel 163 fulfill a relationship of $0.5<[Rct1/(Rbp1+(\Delta P1/Q1))]<2.0$.

Similarly, in the second modified embodiment, the flow channel resistance Rct2 brought about by the plurality of individual channels 165 disposed between the supply port 161*a* and the discharge port 162*a* and the bypass channel 164, the flow channel resistance Rbp2 of the bypass channel 164, the bending loss ΔP2 provided when the ink flows from the first manifold 161 via the bypass channel 164 to the second manifold 162, and the flow rate Q2 of the ink flowing through the bypass channel 164 fulfill a relationship of $0.5<[Rct2/(Rbp2+(\Delta P2/Q2))]<2.0$.

Further, in the exemplary case described above, the first manifold, which has the supply port, is connected to the first throttles of the plurality of individual channels, and the second manifold, which has the discharge port, is connected to the second throttles of the plurality of individual channels. However, there is no limitation thereto. For example, the first manifold, which has the supply port, may be connected to the second throttles of the plurality of individual channels, and the second manifold, which has the discharge port, may be connected to the first throttles of the plurality of individual channels. That is, in the exemplary case described above, it is also allowable that the direction of the flow of the ink, which is provided when the ink is circulated between the head and the ink tank, is opposite to that described above.

Further, in the foregoing description, the present disclosure is applied to the head for constructing the line head. However, there is no limitation thereto. The present disclosure can be also applied to a serial type head which is carried on a carriage and which jets the ink while being moved together with the carriage.

Further, in the foregoing description, the explanation has been made of the exemplary case in which the present disclosure is applied to the head for jetting the ink from the nozzles. However, there is no limitation thereto. It is also possible to apply the present disclosure to any liquid discharge head which jets any liquid other than the ink.

What is claimed is:

1. A liquid discharge head comprising:

a plurality of individual channels arranged in one direction and including a plurality of nozzles respectively;

a first manifold extending in the one direction, being connected to the plurality of individual channels, and including a supply port for a liquid;

a second manifold extending in the one direction, being connected to the plurality of individual channels, and including a discharge port for the liquid; and a bypass channel connecting the first manifold and the second manifold, the bypass channel being distinct from the individual channels, wherein a flow channel resistance Rct brought about by the plurality of individual channels, a flow channel resistance Rbp of the bypass channel, a bending loss ΔP provided when the liquid flows from the first manifold via the bypass channel to the second manifold, and a flow rate Q of the liquid flowing through the bypass channel fulfill a relationship of:

$$0.5<[Rct/(Rbp+(\Delta P/Q))]<2.0.$$

2. The liquid discharge head according to claim 1, wherein the supply port is provided at an end portion of the first manifold disposed on one side in the one direction, wherein the discharge port is provided at an end portion of the second manifold disposed on the one side in the one direction, and wherein the bypass channel connects an end portion of the first manifold disposed on the other side in the one direction and an end portion of the second manifold disposed on the other side in the one direction.

3. The liquid discharge head according to claim 2, wherein the bypass channel includes:

a first channel portion connected to the first manifold; and a second channel portion connected to the first channel portion and the second manifold, and wherein a bending angle between the first channel portion and the second channel portion is not less than 40°.

4. The liquid discharge head according to claim 2, wherein the one direction is a horizontal direction, and wherein the first manifold and the second manifold are aligned in a vertical direction.

5. The liquid discharge head according to claim 1, wherein a total of flow rates of the liquid flowing from the first manifold to the second manifold via the plurality of individual channels and the bypass channel is larger than a total of discharge amounts of the liquid from nozzles per unit time in a case that the liquid is maximally discharged from all of the nozzles of the plurality of individual channels.

6. The liquid discharge head according to claim 1, wherein a viscosity of the liquid is in a range of 1 to 14 [cps].

7. The liquid discharge head according to claim 1, wherein Q is in a range of 0.01 to 0.1 [cc/sec].

8. The liquid discharge head according to claim 1, wherein a viscosity of the liquid is in a range of 7.0 to 8.0 [cps], wherein Rct is in a range of 300 to 400 [kPa/cc/sec], wherein Rbp is in a range of 200 to 300 [kPa/cc/sec], and wherein (ΔP/Q) is in a range of 10 to 20 [kPa/cc/sec].

9. The liquid discharge head according to claim 1, wherein the bypass channel includes:

a first channel portion connected to the first manifold; and a second channel portion connected to the first channel portion and the second manifold; and wherein in a case that a bending angle between the first channel portion and the second channel portion is represented by θ, a loss coefficient calculated by $\zeta=[(0.946\times\sin^2(\theta/2))+(2.05\times\sin^4(\theta/2))]$ is represented by ζ, a fluid density of the liquid is represented by ρ [$kg\cdot m^3$], a gravitational acceleration is represented by g [$m/s^2$], a flow rate of the liquid is represented by u [m/s], and a loss head calculated by $h=\zeta\times(u^2/(2\times g))$ is represented by h [m], the bending loss ΔP is a value calculated by $\Delta P=(\rho\times g\times h)$.

* * * * *